United States Patent [19]

Hafner

[11] 4,184,396

[45] Jan. 22, 1980

[54] LOCKING JOINT MANUFACTURE

[76] Inventor: Otto P. Hafner, 1321 Paddock Way, Cherry Hill, N.J. 08034

[21] Appl. No.: 764,470

[22] Filed: Jan. 31, 1977

[51] Int. Cl.[2] ..... B26D 5/18

[52] U.S. Cl. ..... 83/623; 83/630; 29/432.1

[58] Field of Search ..... 29/432, 432.1, 321, 29/798; 83/623, 630, 627

[56] References Cited

U.S. PATENT DOCUMENTS

| | | | |
|---|---|---|---|
| 3,623,389 | 11/1971 | Kryrytzky | 83/630 |
| 3,724,308 | 4/1973 | Nichols | 83/623 |
| 3,745,868 | 7/1973 | Prentice | 83/630 |
| 3,822,622 | 7/1974 | Smith | 83/623 |
| 3,851,373 | 12/1974 | Shinjo | 29/432.2 |
| 3,863,534 | 2/1975 | Scott | 83/623 |
| 3,900,937 | 8/1975 | Schleicher | 29/432 |

*Primary Examiner*—Gil Weidenfeld

*Attorney, Agent, or Firm*—Weiser, Stapler & Spivak

[57] ABSTRACT

A piercing punch, a piercing die and a swaging punch are displaced relative to each other to produce locking joints by a machine which uses cams, preferably in the form of pairs of mating, wedge-shaped blocks to produce the necessary reciprocating movements of one or more of the three tool elements. A suitable kinematic actuating device, preferably in the form of a toggle linkage reciprocates the third tool element.

The interaction of these elements is such that exceptionally favorable conditions for joint formation prevail.

27 Claims, 11 Drawing Figures

Figure 1:
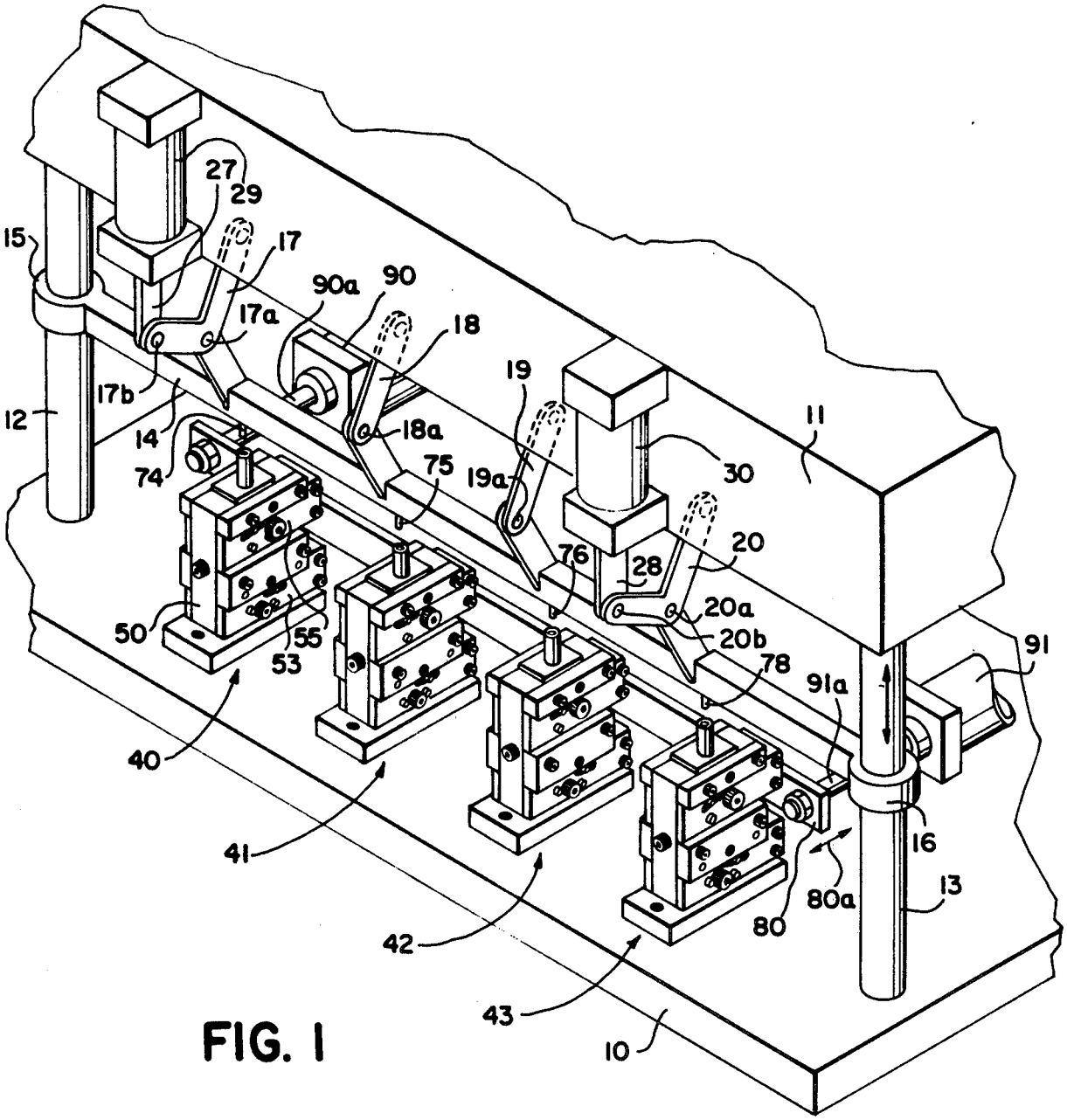

10
11
14
17
17a
17b
40
51
55
60
61
61a
62
63
63a
64
70
71
72
73
74
80
81
90
90a
91
91a
92

11
17
17a
17b
17c
113
111
110
112
131
140
142
130
120
121
141
74
90
91
73
71
60
61
100
101
55
62
63
63a
10
90a
91a 11
17
17a
17b
17c
113
111
112
110
142
131
140
130
141
120
121
74
90
73
91
90a
71
91a
60
61
40a
100
101
55
63
62
63a
10

LOCKING JOINT MANUFACTURE

The present invention relates to new and improved techniques for making certain types of joints between juxtaposed layers of material, such as sheet metal, plastic sheeting, or other material having somewhat ductile properties.

The types of joints in question are known, per se. They are disclosed, for example, in my following prior U.S. Pat. Nos.: 3,726,000 issued on Apr. 10, 1973; 3,862,485 issued on Jan. 28, 1975; 3,885,299 issued on May 27, 1975; 3,924,378 issued on Dec. 9, 1975; 3,934,327 issued on Jan. 27, 1976; 3,981,064 issued on Sept. 21, 1976.

As taught in those prior patents, these joints are formed by partially piercing portions of the several juxtaposed layers, and then flattening or swaging the pierced portions, or at least the pierced portion of the layer or layers closest to the unpierced portion of the material layers. These swaged portions then tend to overlap the unpierced material and lock the joint securely against separation.

A variety of fastening machines have been devised for carrying out the operations involved in making such joints, as exemplified by the patents referenced above. These machines basically function as follows: the layers to be joined are placed between two jaws of the machine. One jaw holds the piercing die, the other a piercing punch. This die and punch then cooperate to perform the partial piercing operation, displacing the pierced layers of material far enough so that they protrude to at least some degree beyond the portions of material which have remained unpierced. The jaw whichs holds the die also holds a swaging of flattening punch. Following the piercing, this swaging punch cooperates with the piercing punch to flatten the pierced (displaced) material portion. During this flattening, or some part of the flattening stroke, the die is preferably used to confine laterally some or all of that displaced material layer which is closest to the swaging punch, while leaving unconfined that displaced material layer which is closest to the piercing punch. As a result, the swaging, or flattening effect takes place selectively in the unconfined layer closest to the piercing punch.

These machines have been generally successful in operation and have proven capable of making such joints. However, this is not to say that further improvements were not desirable. On the contrary, there are a number of important respects in which this fastening maching technology has fallen considerably short of the optimum, without obvious ways to effect appreciable improvements.

One such respect is simplicity of machine construction. As has been explained, there are at least three tool elements involved: a piercing die, a piercing punch, and a flattening punch. Various movements must be performed by these elements during the formation of a joint. These movements are of a reciprocating nature, with different tool elements sometimes moving toward each other, and sometimes away from each other. This complex pattern of movements had given rise to overall machine constructions of considerable complexity.

Further contributing to such complexity was the fact that these tool element movements had to be closely coordinated with one another, both as to distance and timing.

The timing coordination is necessary to make sure that the various individual operations take place at just the time when the tool elements are in the position necessary for that purpose. For example, if it was desired to flatten one displaced layer of material, while leaving another layer unflattened, the piercing and swaging punches had to make their cooperative working movements in reasonably close coordination with the time during which the piercing die surrounded (and thereby confined) the displaced layer which was not to be flattened. In the absence of such timing coordination, the joint would not be optimum.

The coordination with respect to distance of tool element movement is also necessary to produce a satisfactory joint. Again using confinement as an example, the piercing die during the swaging operation must extend by just the right distance along the outer edge of the displaced layer to be confined, or the resulting joint will not be optimum.

These requirements for close coordination have further increased the complexity of prior fastening machines.

A second important respect in which it has been felt that this technology could bear improvement is flexibility. There are numerous applications for the types of joints under consideration. In different one of these applications, there may be encountered different conditions of thickness of the materials to be joined, of their strength, ductility, and other properties. All of these variables, in turn, influence the specifics of fastening machine operation. For example, the lengths of the various reciprocatory movements of the tool elements may have to be substantially different if two thin layers of material are to be joined than if two thick layers are to be joined. In some prior fastening machines it has been a comparatively difficult manner to accommodate such variables. In fact, in some such machines there were no provisions at all for adjustment, and such machines were therefore correspondingly limited in their usefulness.

Also with respect to flexibility, it is desirable to provide the capability to simulatneously make multiple joints in various patterns. It is also desirable to be able to maneuver the fastening machine into different positions to make series of joints at various angles and in various locations. In this respect, too, some prior fastenting machines have left much to be desired.

Still another area of potential improvement resides in the interplay between the various movements of the tool elements and the forces which they exert upon the materials being joined. For example, the swaging operation requires development of the high degree of force which is necessary to produce the desired lateral spreading of the material layer which is being flattened. Yet the tool elements (swaging and piercing punch) must develop that force while moving through only the very small distance represented by the decrease in layer thickness which accompanies its lateral spreading. In a typical case involving the joining of two metal layers, this decrease in thickness may be as little as 10 mils, while the force which has to be exerted may be as high as 4000 lbs., or even higher. In some prior art machines the mechanical arrangements for producing such forces were not ideal with respect to this interplay between force and movement.

Accordingly, it is an object of the present invention to provide fastening machines for producing the types of joints under consideration, but improved in one or more of the foregoing respects.

It is another object to provide such fastening machines which are of comparatively simple construction.

It is another object to provide such machines which have good movement coordination between the various tool elements.

It is another object to provide such machines which have good timing coordination between the elements.

It is still another object to provide such machines whose tool elements exert powerful forces while moving through short distances.

It is still another object to provide such machines which can simultaneously produce patterns of several joints.

It is still another object to provide such machines which can be readily maneuvered into position with respect to the workpiece to be joined.

These and other objects which will appear are accomplished in accordance with the present invention as follows. Of the three tool elements which are used in the fastening machine (namely the die and the two punches) at least one tool element has its reciprocating movements imparted to it by camming means, preferably in the form of inclined plane means.

A second of the three tool elements used in the fastening machine embodying the invention preferably has its required reciprocating movements imparted to it by a toggle means.

In some of the embodiments of the invention reciprocating movements must also be imparted to the third tool element used in the machine. When that is the case these movements are preferably also imparted by camming means which are preferably in the form of inclined plane means.

Thus, in a particularly preferred embodiment, the piercing die is reciprocatingly moved as needed by an inclined plane means, the piercing punch which cooperates with the piercing die is moved by a toggle means, and the swaging punch which cooperates with the piercing punch to flatten the joint material is also moved by an inclined plane means.

Figure 2:
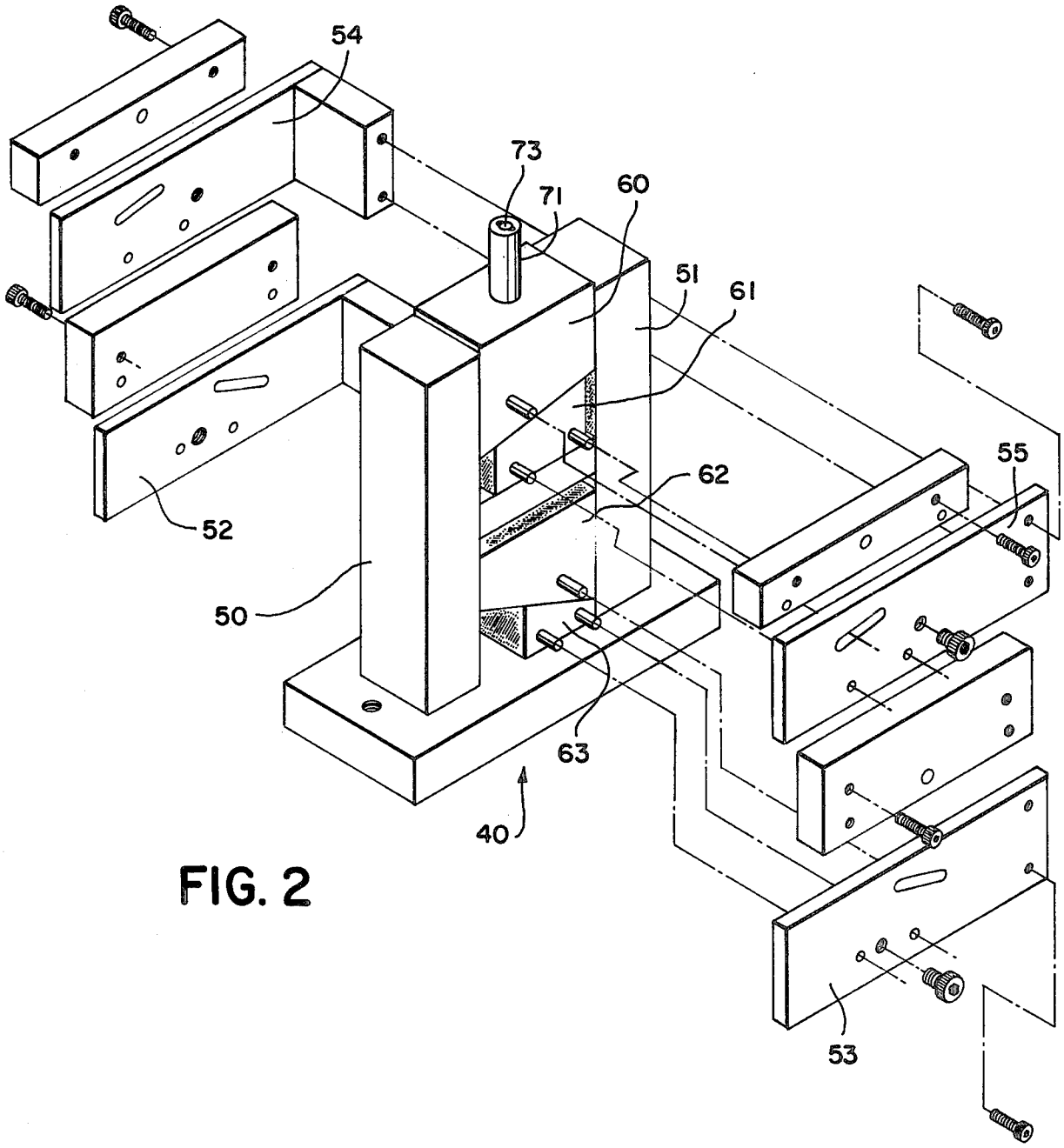
Figures 4A, 4B:
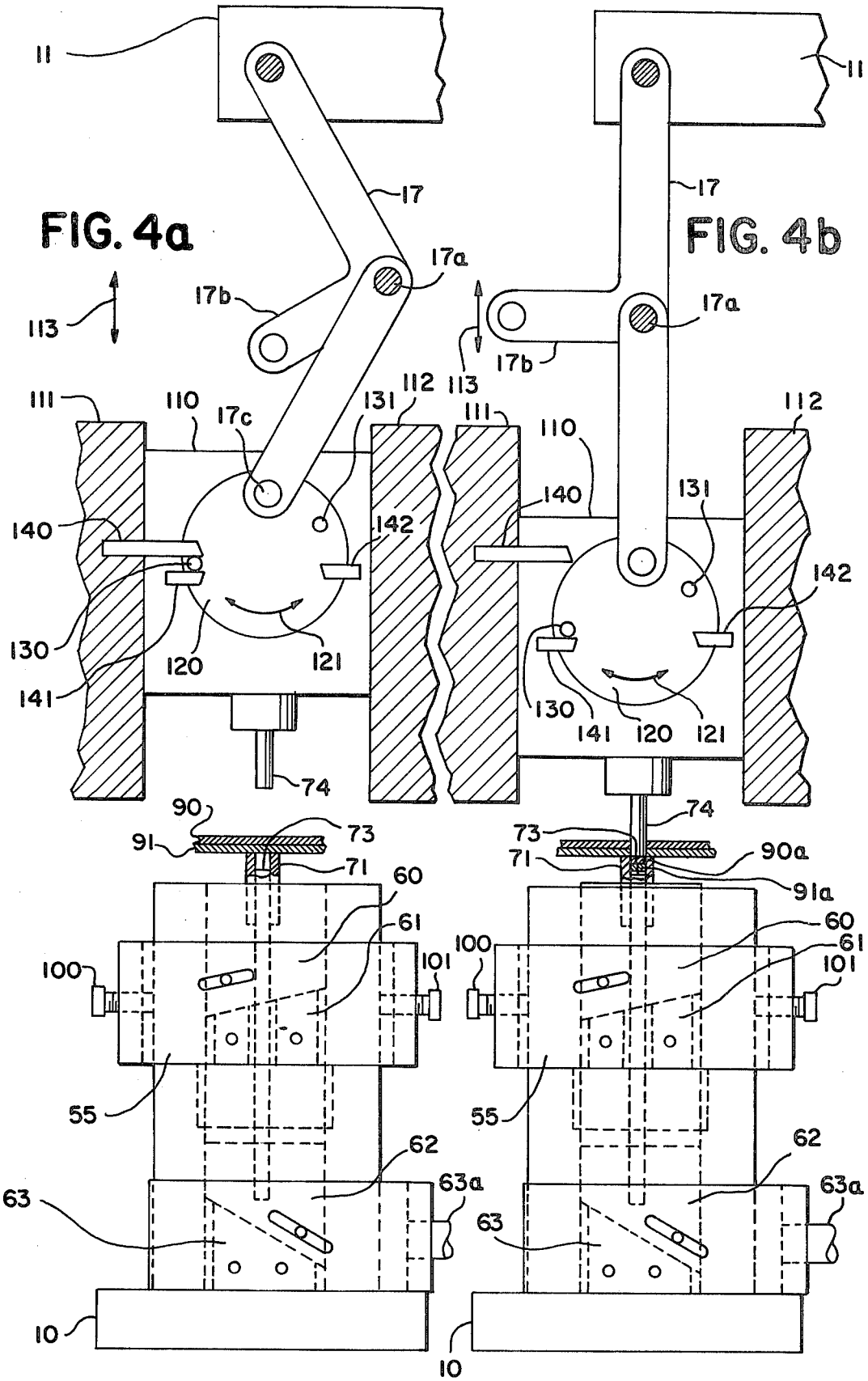
Figures 4C, 4D:
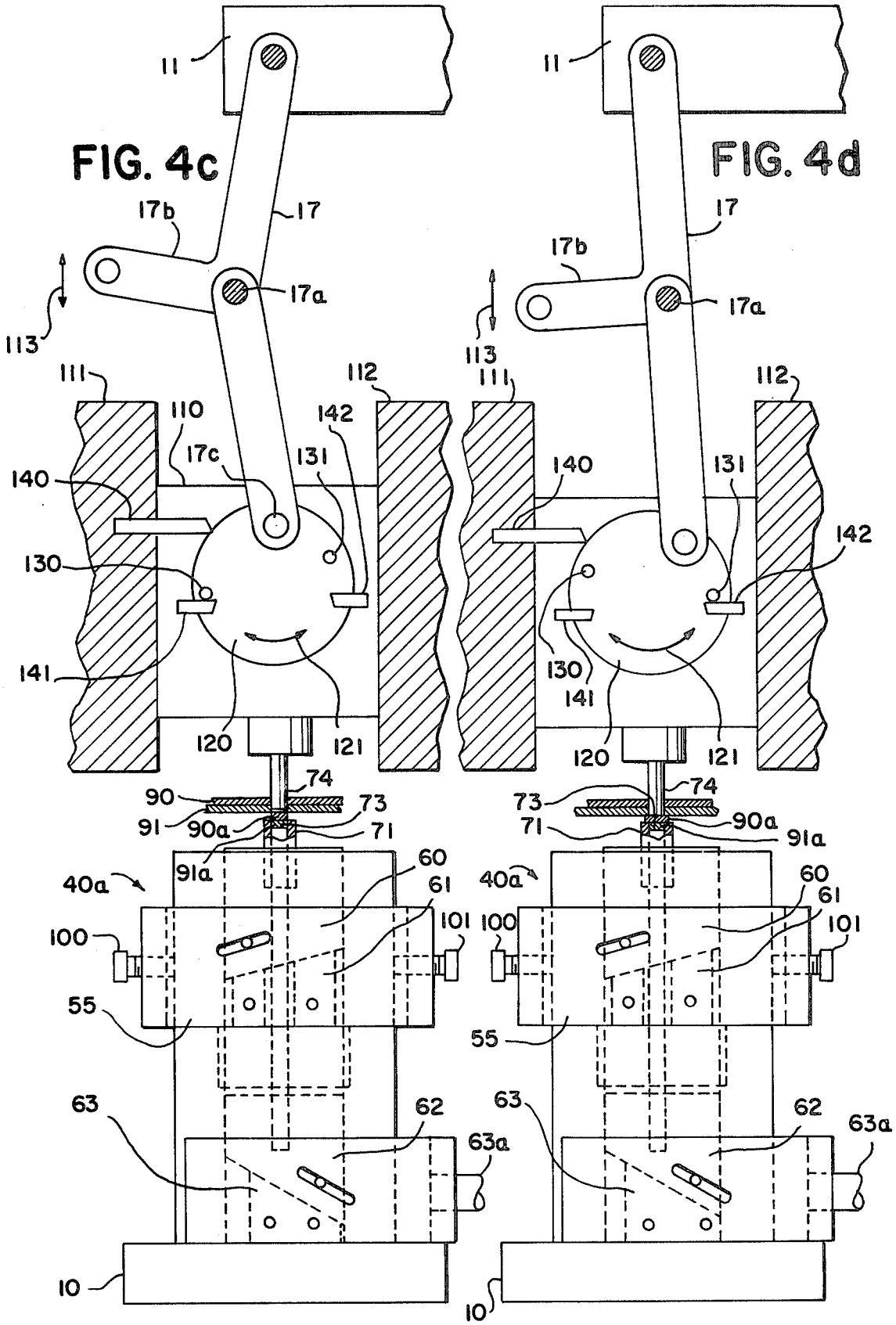
Figure 5:
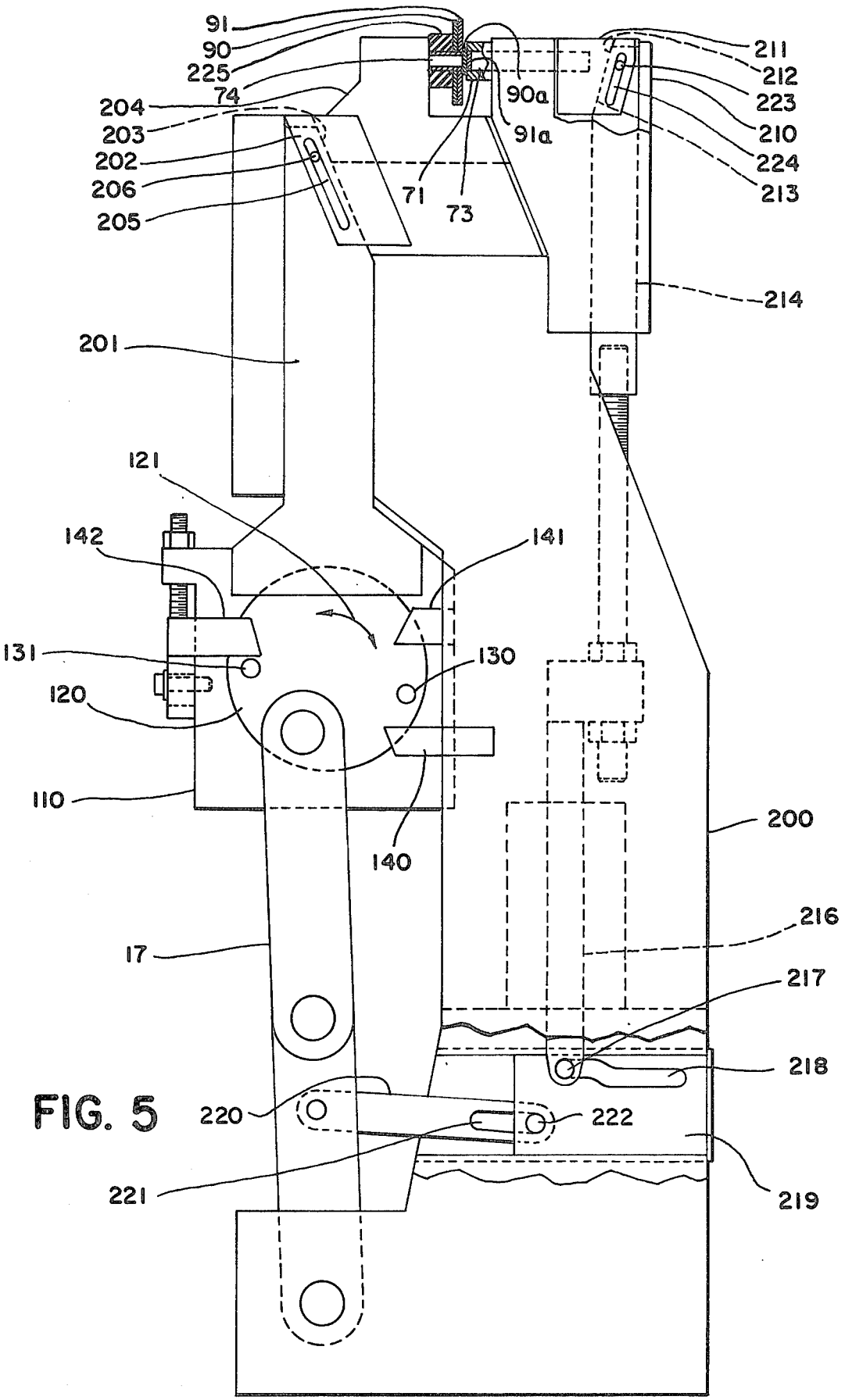

For further details, reference is made to the discussion which follows, in the light of the accompanying drawings wherein FIG. 1 is an isometric view of a fastening machine constituting a preferred embodiment of the invention;

FIG. 2 is an exploded view of one of the principal constituents of the machine of FIG. 1;

FIGS. 3*a* through 3*d* are all diagrammatic illustrations of the operation of the machine of FIG. 1, showing several successive stages in one complete cycle of operation for forming a joint;

FIGS. 4*a* through 4*d* are diagrammatic illustrations showing successive stages in a cycle of operation of another embodiment of the invention; and FIG. 5 is an illustration of a third embodiment of the invention.

The same reference numerals are used in the various figures to designate corresponding elements.

Referring to FIG. 1, this shows two stationary frame members 10, 11 and vertical support columns 12, 13, positioned between frame members 10, 11. A cross bar 14 is movable up and down between frame members 10, 11. This cross bar 14 terminates in collars or bearings 15, 16 which are in slidable engagement, respectively, with support columns 12, 13.

A plurality of toggle linkages 17, 18, 19 and 20 are connected between cross bar 14 and upper stationary frame member 11. These toggle linkages are pivotable at their points of attachment to both stationary frame member 11 and cross bar 14. They are, of course, also pivotable at their respective junction points 17*a* through 20*a*. Two of these toggle linkages 17 and 20 have actuating arms 17*b* and 20*b* respectively protruding from their upper linkage arms. The extremities of these actuating arms 17*b* and 20*b* are, in turn, connected with the operating rods 27, 28, respectively, of hydraulic cylinders 29, 30. As is more fully explained hereafter, these hydraulic cylinders 29, 30 are mounted vertically and are actuatable to cause their reciprocating shafts 27, 28 to move up and down in unison upon command. Such vertical reciprocating movement of shafts 27, 28 in turn imparts through actuating arms 17*b*, 20*b* toggle movements to toggle linkages 17, 20. These same toggle movements are further transmitted to toggle linkages 18, 19 through the resulting up and down movement of cross bar 14.

Resting upon the lower stationary frame member 10 are a plurality of tool holding assemblies 40 to 43. A typical such assembly 40 is also shown in FIGS. 2 and 3*a* through 3*d*. This tool holding assembly includes a pair of outer support posts 50, 51 (see FIG. 2, for example). Horizontally bridging these support posts 50, 51 are two pairs of side plates, the lower pair 52, 53 and the upper pair, 54, 55. Within the space defined by posts 50, 51 and side plates 52 through 55, there are four movable members or blocks numbered, from top to bottom, by references numerals 60, 61, 62 and 63. As clearly appears in both FIGS. 2 and 3*a* through 3*d*, the mating surfaces between the upper two of these movable blocks 60, 61 are inclined relative to the vertical. Likewise, the mating surfaces between the lower pair of movable blocks 62, 63 are inclined relative to the vertical. Also, for reasons which will appear presently, these mating surfaces are oppositely inclined from each other with respect to the vertical. Thus blocks 60 to 63 can all be termed wedge-shaped.

As shown in FIGS. 3*a* through 3*d*, each of wedge-shaped blocks 61 and 63 is attached to an actuating rod, respectively designated by reference numerals 61*a* and 63*a*. Reciprocating movement of these actuating rods in the direction of double headed arrow 64 imparts to blocks 61 and 63 corresponding reciprocating horizontal movements. These horizontal movements of blocks 61 and 63, in turn, produce vertical sliding reciprocating movements of blocks 60 and 62, respectively resting thereon. Block 60 has in it a recess 70 for receiving piercing die 71. Block 62 has in it a recess 72 for receiving swaging punch 73. These tool elements are also aligned coaxially with respect to each other, so that the top end of swaging punch 73 is received within piercing die 71. It will be understood that a suitable aperture extends vertically through both blocks 60 and 61 through which swaging punch 73 can extend upwardly.

Figures 3A, 3B, 3C, 3D:
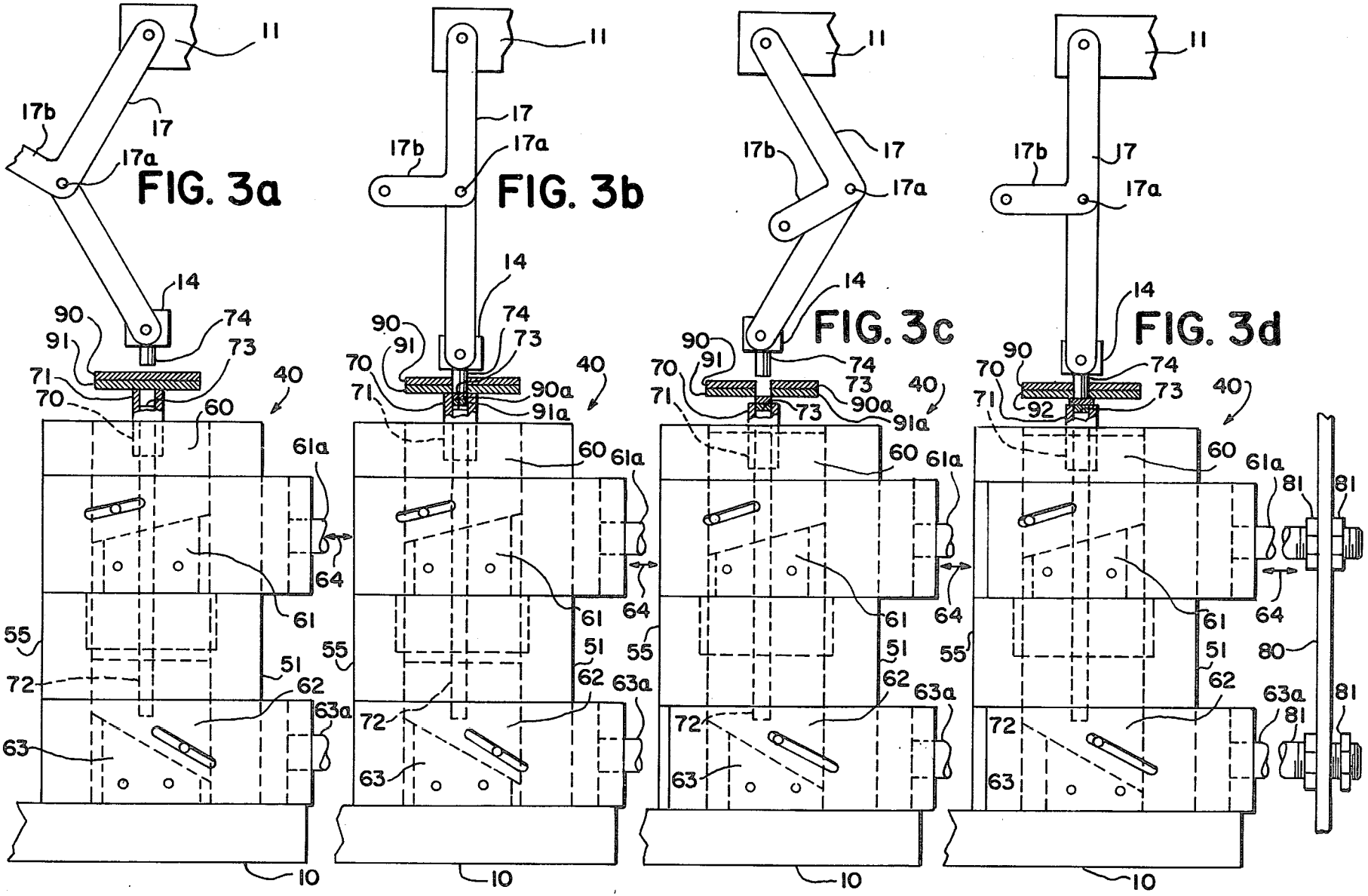

Referring to FIG. 1, a horizontal actuating bar 80 is shown behind and across all four tool holding assemblies 40 through 43 (see also FIG. 3*d*). Both of the actuating rods 61*a* and 63*a* extending from each of these tool holding assemblies are connected to actuating bar 80 as best shown in FIG. 3*d*. As a result, movement of this bar reciprocally forward and backward in the directions indicated by two headed arrow 80*a* in FIG. 1 causes blocks 61 and 63 (FIGS. 2 and 3*a* through 3*d*) to also reciprocatingly slide back and forth forward and backwards, or left to right in FIGS. 3*a* through 3*d*. To impart this reciprocating motion to actuating bar 80, there are provided two hydraulic cylinders 90, 91 whose operating rods 90*a* and 91*a* are atttached to opposite ends of actuating bar 80. This reciprocating movement obviously translates, due to the inclined plane configuration of the mating surfaces previously discussed, into reciprocating up and down movement of tool holding blocks 60 and 62 and thereby into reciprocating up and down movements of piercing die 70 and swaging punch 73.

In the bottom of cross bar 14 (FIGS. 1 and 3*a* through 3*d*) there are provided receptacles for holding a piercing punch 74, opposite end directly in coaxial alignment with piercing die 71 and swaging punch 73. Other similar piercing punches 75, 76 and 78 are positioned in similar coaxial alignment with the corresponding tool elements of tool holding assemblies 41, 42 and 43 (FIG. 1).

A cycle in the operation of this apparatus is illustrated in FIGS. 3*a* through 3*d*, to which particular reference may now be had. At the beginning of the cycle, toggle linkage 17, as shown in FIG. 3*a*, is flexed in one direction, thereby lifting cross bar 14 and piercing punch 74. At the same time, sliding wedge-shaped blocks 61 and 63 are in the positions shown in FIG. 3*a*, which is near the extreme right-hand ends of their possible paths of travel. This, in turn, positions piercing die 71 with its top cutting edge substantially above the top end of swaging punch 73. The assembly thus defines between piercing punch 74 and piercing die 71 the jaws of the fastening machine. Between these punch and die tool elements 74, 71, there is positioned the material to be fastened. In the illustration of FIGS. 3*a* through 3*d*, this has been shown as consisting of two juxtaposed layers of material 90, 91. Layer 91 rests directly upon the open end of piercing die 71 and layer 90, in turn, rests on top of layer 91.

The next succeeding stage in the cycle is shown in FIG. 3*b*. This shows the extreme end of actuating arm 17*b* depressed relative to the position which it had in FIG. 3*a*. This occurs under the influence of the operating rod 27 of cylinder 29 in FIG. 1. The toggle linkage 17 is shown in its fully extended, or toggled condition in FIG. 3*b*. This has caused piercing punch 74 to descend and pass through both layers 90, 91. In the process, these two layers of material have been pierced and portions 90*a* and 91*a* displaced downwardly out of the planes defined by the original layers 90, 91. The configuration of the cutting edges and surfaces of piercing die 71 and piercing punch 74 is such that the separation between the displaced portions 90*a* and 91*a* and the remaining undisplaced portions of layers 90, 91 takes place only along parts of the periphery of these separated portions. Along the remainder of the periphery, the displaced portions 90*a* and 91*a* remain attached to the undisplaced portions. This is entirely conventional in this type of technology and need therefore not be further described. For fuller information, reference is made to my previously identified prior patents which deal with this subject in detail.

The next succeeding stage of operation is shown in FIG. 3*c*. There, the extremity of actuating arm 17*b* is shown still further depressed, again under the influence of cylinder 29 and operating rod 27 in FIG. 1. This, in turn, has carried toggle linkage 17 beyond the toggle position shown in FIG. 3*b* and into a flexed condition opposite to that of FIG. 3*a*. This, in turn, has caused lifting of cross bar 14 and with it of piercing punch 74. This piercing punch therefore no longer bears down upon displaced material portions 90*a* and 91*a*. According rods 61*a* and 63*a* have also been displaced to the right and with them wedge-shaped blocks 61 and 63, which now have assumed the positions illustrated in FIG. 3*c*. This has had opposite effects upon the tool elements carried by tool holding assembly 40. Block 62 has been caused to move vertically upward by the displacement to the right of block 63. Likewise, swaging punch 73 has been caused to move vertically upward since it is retained within and carried by block 62 as previously explained.

Conversely, block 60 has been caused to move vertically downward carrying with it in the same direction punching die 71 retained within block 60. This leaves these two tool elements carried by tool holding assembly 40 in the positions illustrated in FIG. 3*c*. In that position swaging punch 73 has its working face in engagement with the bottom surface of lower displaced portion 91*a*. Piercing die 71 has been retracted downwardly from the position it occupied in previous stages of the cycle (FIGS. 3*a* and 3*b*) until it no longer surrounds the outer periphery of both displaced portions 90*a* and 91*a*, but instead surrounds only the lower of these two displaced portions, namely portion 91*a*.

The final stage in the cycle is shown in FIG. 3*d*. Here, actuating arm 17*b* has moved upwardly again, into the same position as in FIG. 3*b*, under the influence of cylinder 29 and operating rod 27. This again places linkage 17 into its toggled position, namely with both arms of the linkage straight in line. By so doing, piercing punch 74 is again brought down to bear upon pierced portion 90*a*. However, since portions 90*a* and 91*a* have, in the interim, been elevated slightly by the movement of swaging punch 73 described in connection with FIG. 3*c* above, there will now be exerted a compression force upon displaced portions 90*a* and 91*a* between piercing punch 74 and swaging punch 73. This will cause both displaced portions 90*a* and 91*a*to try and flatten. However, this tendency is counteracted for bottom portion 91*a* by the fact that it is encircled by piercing die 71, as previously described. No such counteracting effect prevails for upper displaced portion 90*a* which is free of encirclement by piercing die 71. Consequently, displaced portion 90*a* will flatten and in the process expand laterally thereby creating the desired locked condition for the joint which is being produced.

From the stage of operation shown in FIG. 3*d*, the machine then returns to the stage shown in FIG. 3*a*. At that stage, the material containing the previously formed joint can be removed from the jaws of the machine and a new work piece introduced for joining.

It will now be appreciated that this machine of FIGS. 1, 2 and 3*a* through 3*d* embodies the advantages of the present invention.

The overall mechanism is extremely simple. It consists, in its most essential aspects, of nothing more than two reciprocating inclined plane means and one reciprocating toggle means. The toggle means is caused to go through toggle twice for each reciprocating movement of the inclined plane means. In this way, two power strokes are delivered by the toggle means, each time it passes through toggle, with a single reciprocating movement of its actuating means, which is cylinder 29 and operating rod 27 causing displacement of actuating arm 17*b*.

The coordination between the three tool elements (piercing die 71, piercing punch 74 and swaging punch 73) is precise both with respect to timing and with respect to displacement distances. Timing coordination is achieved with the greatest ease by coordinating the back and forth movements of operating rods 27, 28 (FIG. 1) and operating rods 90*a* and 91*a* (also FIG. 1). Conventional hydraulic valve controls produce such coordination via hydraulic cylinders 29, 30, 90 and 91.

Flexibility, particularly with respect to adjustment of the distances traversed by the tool elements to conform with the requirements of different materials being joined, is both convenient and reliable. The toggle linkage 17 requires no adjustment at all. On the other hand, the positions and displacements of piercing punch 71 and swaging punch 73 are made, either by changing the strokes of pistons 90, 91 (FIG. 1), or by appropriately varying the connections between actuating rods 61*a*, 63*a* and actuating bar 80 (also FIG. 1). For example, the end of actuating rod 61, 63*a* closest to actuating bar 80 can be made threaded and, by positioning nuts 81 either tightly against actuating bar 80 on each side or spaced apart, the distance of movement of actuating rods 61*a* and 63*a* can be independently controlled. This, in turn, independently controls the up and down movements of piercing die 71 and swaging punch 73.

The relationship between distance of tool movement and force exerted is also highly favorable. Both operating strokes of the machine, for piercing (FIG. 3*b*) and for swaging (FIG. 3*d*), are carried out as the toggle linkage 17 passes through toggle. It is well known that, as a toggle linkage comes close to its toggled condition, it transmits a very powerful force which is at its maximum right at the toggled position when the arms of the linkage are directly in line. Yet, the longitudinal displacement is very small at that same portion of the toggle cycle. These conditions are obviously ideal for the production of the type of joint under consideration. First, they insure a powerful piercing force and later they insure a powerful swaging or flattening force. In the latter case, particularly, this force is exerted with only a very small lengthwise displacement corresponding to the decrease in thickness of the work piece layer potion being flattened.

In addition, this machine has other desirable properties. In particular, it is exceptionally sturdy and rugged and durable and has exceptionally good life. This is due in part to the toggle linkage for applying heavy force as previously explained and in part to the use of the broad bearing surfaces provided by the various inclined plane means. These broad bearing surfaces distribute the forces and reduce the wear on each individual unit of the surface. They also lend themselves to easy lubrication. In addition, the shapes are very simple and correspondingly convenient and inexpensive to manufacture.

Turning now to the embodiment of FIGS. 4*a* through 4*d*, it will be seen that this has numerous similarities to that of FIGS. 1 through 3. With respect to the tool holding assembly, which is designated by reference numeral 40*a* in FIGS. 4*a* through 4*d* in order to highlight the fact that it does differ in some respect from tool holding assembly 40 of the embodiment of FIGS. 1 through 3, this difference resides in that the upper side plates 54, 55 (of which only plate 55 is visible in FIGS. 4*a* through 4*d*) are not subject to reciprocating actuation by an actuating rod 61*a*. Rather, they are horizontally reciprocable by set screws 100, 101. Once these set screws are adjusted, the horizontal positioning of the side plates is fixed until the set screws are readjusted. As a result, the horizontal position of wedge-shaped block 61 is likewise fixed and so is the vertical position of wedge-shaped block 62 and of piercing die 71 carried thereby. In all other respects, tool holding assembly 40*a* is similar to tool holding assembly 40.

This can also be accomplished by die holder which does not involve an inclined plane arrangement, but an up-and-down screw adjustment locking into appropriate position.

With respect to the remainder of the machine of FIGS. 4*a* to 4*d*, the piercing punch 74 is again actuated by a toggle linkage 17. However, this toggle linkage 17 now no longer terminates in a simple pivot at bar 14 carrying the piercing punch 74. Rather this interconnection between toggle 17 and piercing punch 74 is somewhat more complex. It consists of a block 110 which is positioned between vertical tracks 111, 112 for vertical sliding movement up and down between these tracks in the directions indicated by double headed arrow 113. Retained within a circular aperture inside block 110 is a circular disc 120. This disc is free to rotate, subject to constraints discussed below, within block 110 in either direction as indicated by two headed arrow 121.

The bottom end of linkage 17 is pivotally attached at 17*c* to a point which is close to the periphery of disc 120 and also azimuthally near the top of the disc. Two pins 130 and 131, protrude from the disc 120. One of these pins 131 is displaced clockwise approximately 45° from pivot point 17*c*. The other pin 130 is displaced a little more than 90° counterclockwise from the same pivot point 17*c*.

From track 111 there protrudes into the path of block 110 a stop member 140. From block 110 itself, there protrude into the area defined by disc 120 two additional stop members 141 and 142. The relationship between the dimensions and positions of all of these elements associated with block 110, disc 120 and track 111 is such that the following events take place as toggle linkage 17 is caused to oscillate in the manner represented in FIGS. 4*a* through 4*d*. First, as shown in FIG. 4*a*, the toggle linkage is flexed to the right. In that condition, the toggle linkage 17 pulls upwardly at pivot point 17*c* and causes block 110 to slide upward between tracks 111 and 112. This upward movement eventually causes pin 130 to abut against projection 140 whereby disc 120, upon continuing upward movement, is caused to rotate counterclockwise to the extent necessary to produce the alignment between parts visible in FIG. 4*a*. This movement then ceases when pin 130 protruding from disc 120 abuts not only against projection 140 at the top but also against projection 141 at the bottom.

From the position shown in FIG. 4*a*, the toggle linkage 17 is then brought into the toggled position shown in FIG. 4*b*. This, of course, causes extension of the toggle linkage arms until they are in the directly aligned position of FIG. 4*b*. This, in turn, causes downward movement of block 110 beteen tracks 111 and 112. During this movement of toggle linkage 17, the forces are applied to disc 120 in a direction having both a downward and a counterclockwise component, pin 130 continues to bear against projection 141 and therefore no further rotational movement of disc 120 takes place.

From the position shown in FIG. 4*b*, the toggle linkage 17 is brought into the position shown in FIG. 4*c*. This is a flexed-to-the-left position which causes some upward movement of block 110. However, the rotational force on disc 120 remains counterclockwise, which is again prevented from so rotating by pin 130 bearing on projection 141.

The final movement of linkage 17 is from the position shown in FIG. 4*c* to that shown in FIG. 4*d*. This, it will be seen, is again a toggled position with the arms of linkage 17 directly in line. Moreover, this also causes lowering of block 110. However, during this movement into the toggled position from that shown in FIG. 4*c*, the force exerted upon disc 120 will have a clockwise component. This causes disc 120 to rotate clockwise until such movement terminates because pin 131 has rotated into bearing against projection 142.

This is again followed by a continuation of the movement carrying toggle linkage 17 again into the flexed position shown in FIG. 4*a* whereupon the cycle described above can begin again.

It will now be seen that the two passages through the toggled position, namely that in FIG. 4*b* and that illustrated in FIG. 4*d*, both produce downward movements of block 110 carrying piercing punch 74. However, the downward movement corresponding to FIG. 4*b* will be slightly longer than that corresponding to FIG. 4*d*. The significance of this to the operation of this embodiment of the invention is described in more detail below.

In this embodiment, the work piece consisting of material layers 90 and 91 is again placed in the jaws of the machine when the tool elements are in the position illustrated in FIG. 4*a*. In that position, piercing die 71 is up, piercing punch 74 is up and away from the piercing die, thereby defining an open jaw for the insertion for the work piece, and swaging punch 73 is retracted below the top of piercing punch 71. During the first passage through toggle of linkage 17 (FIG. 4*b*), piercing punch 74 descends and displaces portions **90*a* and 91*a* of work piece 90, 91**.

During these two stages of the cycle, actuating rod **63*a*** remains stationary in the position shown in FIGS. 4*a* and 4*b* and so does swaging punch 73. Piercing die 71 remains stationary throughout the cycle.

In the next succeeding stage, illustrated in FIG. 4*c*, the piercing punch 74 has retracted. However, at the same time, the swaging punch has moved upwardly, as a result of actuating rods **63*a* having been displaced toward the left, thereby causing upward movement of block 62 which carries flattening punch 73. This upward movement has been sufficient to raise displaced material portions 9*a* and 91*a*** from the positions which they occupied in FIG. 4*b*. In particular, these portions are raised sufficiently so that portion **90*a* is no longer encircled by the piercing die 71, whereas portion 91*a* continues to be within and encircled by the mouth of piercing die 71. When toggle linkage 17** then again passes through its toggled position, as illustrated in FIG. 4*d*, during the next succeeding stage of the cycle, piercing punch 74 is brought to bear against these previously raised portions **90*a*, 91*a*. Since these are still supported from below by swaging punch 73 they will be subjected to compression between these punches and portion 90*a* will be flattened and will spread out laterally to lock the joint, as required. Because of the intervening raising of portions 90*a* and 91*a***, it is necessary to slightly shorten the downward stroke during the stage represented in FIG. 4*d*, relative to the downward stroke used for piercing during the stage shown in FIG. 4*b*. This is achieved by the block and disc arrangement previously discussed.

Following passage through the stage shown in FIG. 4*d*, everything returns to the positions illustrated in FIG. 4*a*, whereupon the work piece with the layers joined can be removed, a new work piece inserted in the jaws, and the cycle repeated. As was the case for the embodiment of FIGS. 3*a* through 3*d*, that of FIGS. 4*a* through 4*d* which has just been described can be utilized in a manner similar to that illustrated in FIG. 1. Thus a plurality of toggle linkage operated punches 74 can be combined with a corresponding number of assemblies **40*a* and the punches 71 and 73 carried thereby, in a structure similar to that illustrated in FIG. 1. In that case, the assemblies 40*a* would be aligned on a base 10 in the manner corresponding to that illustrated for assemblies 40 in FIG. 1. However, the bar 80 which actuates the slides of all of these elements 40*a* would be connected only to the bottom slide 62 through its actuating rod 63*a* and there would be no connection from bar 80 to upper slide 61**.

The toggle linkages 17, on the other hand, would be operated by cylinders 29,30, as in the machine of FIG. 1.

Coordination between the different movements would be again carried out by a conventional hydraulic control circuit (not shown).

It is also possible to utilize the principles of the present invention in a tool in which all of the elements are part of a single, permanently assembled unit, rather than being essentially separate physical structures as in the case of the embodiments of FIGS. 3 and 4. Such an additional embodiment is illustrated in FIG. 5, to which reference may now be had.

This embodiment includes a main frame member 200 to which all of the other components are attached. There will immediately be recognized a number of similarities to the other embodiments of the invention previously discussed. For example, it will be seen that there is a toggle linkage 17 which operates a slidable block 110 within which there is retained a disc 120 capable of rotating in either of the directions indicated by two-headed arrow 121.

Movement of toggle linkage 17 obviously cause reciprocating movement up and down of block 110. This in turn causes corresponding movements of arm 201 attached to block 110. Arm 201 terminates in inclined surface 202. There it meets with the inclined surface 203 of block 204, to which up and down movements of arm 201 impart corresponding right and left movements. These, in turn, are transmitted to piercing punch 74 attached to block 204. Rightward movement of block 204 occurs in response to upward movement of arm 201. Leftward return movement of block 204 occurs in response to downward movement of arm 201 through the agency of slot 205 and pin 206 engaged in that slot. Pin 206 is attached to arm 201, whereas slot 205 is diagonally in an extension of block 204.

Facing and coaxial with piercing punch 74 is piercing die 71 and swaging punch 73. Die 71 is fixedly attached to a fixed member 210 forming an extension of frame 200. On the other hand, swaging punch 73 is attached to block 211, whose inclined bottom surface 212 rests upon a mating inclined surface 213 of block 214. This block 214 is actuatable up and down by connecting members 215 and 216. The far end of connecting member 216 has a pin 217 slidably engaged within a camming slot 218 of block 219. Block 219, in turn, is reciprocable left and right in response to movement of connecting linkage 220 which has a slot 221 in which there is engaged a pin 222 protruding from block 219. Slot 221 provides a dwell in the movement of block 219 in response to movements of connecting linkage 220.

It will be seen that up and down movements of member 214 will translate themselves into left-right movements of block 211 and therefore also of swaging punch 73. Return movements of this swaging punch are facilitated and assured by pin 223 extending from block 214 and engaged in slot 224 formed in an extension of block 211.

It will now be seen that, as toggle linkage 17 is reciprocated first on one side of toggle and then on the other, passing through the fully extended condition of the linkage each time, there will take place a set of coordinated actions at the end of the device of FIG. 5 where punches 73, 74 and die 71 are positioned such that there will first be produced a rightward movement of piercing punch 74 which will cut through layers 90 and 91 to be joined. This will then be followed by a leftward movement of swaging punch 73, after which there will be another but shorter rightward stroke of piercing punch 74 which will cooperate with swaging punch to flatten and expand the portion 90*a* previously punched out and displaced. Stop member 142 is adjustable by screw arrangement to vary the amount that disc 120 can rotate, thus varying the movement of arm 201 on the return stroke—even to the point where the toggled positions are the same on the forward or return strokes. In this way, the degree of swaging force and amount of flattening can be controlled.

In FIG. 5 these elements have all been shown at the end (or flattening stage) of this cycle, with the swaging punch 73 at the extreme left of its movement, and the piercing punch 74 at the lower end of its shorter rightward stroke. This yields the relationship between elements 90, 91 and 90*a*, 91*a* illustrated in FIG. 5. In the next stage of the movement of the machine of FIG. 5, the piercing punch 74 again retracts left and frees the layers 90, 91 for removal and replacement with a new set of layers to be joined. Attention is also invited to annular member 225 which is preferably attached surrounding the top of piercing punch 74. This member 225 is preferably made of resilient material and serves to strip the pierced portions of layers 90, 91 from punch 74 after the piercing and swaging cycle has been completed.

Due to the unitary construction of this machine of FIG. 5, the actuating force for the entire machine can be provided at a single input. For example, a hydraulic cylinder (not shown) may be used to act upon toggle linkage 17 so as to produce reciprocating movement thereof on opposite sides of its toggled condition and also through that toggled condition form opposite directions.

Also due to its unitary construction, the machine of FIG. 5 can be thought of as a portable machine. In the machine embodiments of FIGS. 1 through 4, the workpiece, in practice, needs to be brought to the machine, which has to be set up in advance so that it will produce the joint or joints at the desired positions on the workpiece. In contrast, the machine of FIG. 5 may, if desired, be moved to the workpiece and there used as many times as necessary to produce the desired pattern of joints.

In practice, this machine may be quite heavy, of the order of perhaps 100 lbs. in weight. Therefore, it may be desirable to suspend it for movement in a suitable counterbalanced support arrangement, so that the operator only needs to maneuver it into operating position, but without also having to support its weight.

In all of these embodiments it will be seen that the toggle action, particularly, produces in effect two force applying movements for a single reciprocating movement of the actuating element. Considering, for example, cylinders 29, 30 of FIG. 1 as the actuating elements, one reciprocating movement of the piston rods 27, 28 extending from these cyliners produces two consecutive passages of toggle linkage 17 through its toggled condition. In each of these the force associated with a fully extended toggle linkage is produced. In between these consecutive toggled conditions, the flexing of the toggle linkage relieves the force while other members of the machine are repositioned for the next force application.

It will also be recognized that all these embodiments of the invention are characterized by wide latitude, and great convenience of adjustment for various conditions of use. In each embodiment—even the unitary one of FIG. 5—individual tool elements (punches and die) are readily and conveniently adjustable, and these adjustments can be made individually for each of these tool elements, whereby the movements of the tool elements relative to each other can be adjusted. Such adjustment makes it possible to accommodate various numbers and thicknesses of material layers. They also make it possible to vary the degree and duration of confinement of displaced material during swaging, including even no confinement at all. In this way a wide variety of joints, as disclosed, for example, in my above-mentioned prior patents, can be made.

It should also be noted that, in the embodiment of FIGS. 1 through 4, the movements of the various inclined plane means are not utilized to transmit joint-forming forces, as such. Rather, these movements are used only to reposition the tool elements affected thereby. The joint-forming forces are then exerted while the inclined plane means are stationary in one or another of their possible positions. The actuating means for the inclined plane means are therefore not under heavy load while moving.

In the embodiment of FIG. 5, on the other hand, the inclined plane means also transmit joint-forming forces during their movements. Block 204 does so during both piercing and swaging; block 211 during swaging.

It will be understood that various other modifications of this invention are possible without departing from its inventive concept.

For example, the number of tool-holding assemblies is not limited to the four such assemblies 40 to 43 shown by way of illustrative example in FIG. 1. Rather this number may be greater or lesser, depending on the number of joints which it is desired to make at one time. Also, these assemblies (and their corresponding piercing punches 74 to 78) need not be positioned in a straight row, as shown in FIG. 1, but may be positioned in other patterns, conforming to the patterns of joints to be made at any one time.

Also, any one such assembly can be made to hold, positioned side-by-side, the tool elements for making more than one joint at a time. This makes it possible to produce multiple joints very close to one another. It will be understood that, in such cases, additional piercing punches will also have to be provided facing these assemblies within a machine such as shown in FIG. 1, for example.

With regard to the inclined plane means used within the machine to displace one or more of the tool elements, it is not essential that these be so constructed that a right-angle change in direction of movement takes place between any two mating blocks. Other angular relationships can also be used, provided they are effective to produce the movements which inclined planes yield.

Indeed, although inclined plane means are preferred, it will be recognized that other camming means may be used to produce movements of tool holding means such as blocks 60 and 64 in FIGS. 2, 3 and 4.

The use of toggle linkages—although preferred—is also not indispensable. Other means for displacing and applying forces to the third tool elements may be used, including even a third inclined plane means, or a directly hydraulically driven ram, or a so-called Scotch yoke movement.

Conversely a toggle linkage may be used to impart the reciprocating movements to the inclined plane means of FIGS. 1 to 4.

The actuating means in FIG. 1 need not be hydraulic cylinders. They can be air cylinders. They can also take entirely different forms, e.g. bell crank arrangements.

If an actuating cylinder (hydraulic or air) is used to reciprocate bar 80 in FIG. 1 (see also FIG. 3*d*), this cylinder could be positioned vertically below frame member 10, and connected to a dog-leg cam for converting the up-and-down movements of its operating rod to the horizontal movements to be imparted to bar 80.

I claim:

1. A machine for operating on a workpiece from opposite sides by carrying out relative displacements along coaxial paths between a plurality of tool elements, the machine comprising:

first and second means for respectively holding first and second ones of the tool elements coaxially in positions confronting the same one side of the workpiece, the holding means being reciprocably moveable parallel to the tool displacement paths, and each holding means having a plane surface portion inclined with respect to the displacement paths; and first and second actuating means for producing the reciprocal movements of the first and second holding means respectively, each actuating means having a plane surface portion which mates with the inclined plane surface portion of the respective holding means actuated thereby, and being reciprocable along a path which forms angles with the tool element displacement paths and with the plane surface of the respective holding means.

2. The machine of claim 1 further comprising means connecting each actuating means and its respective mating tool holding means to maintain mating during reciprocation of the actuating means.

3. The machine of claim 2 wherein the connecting means includes a pin protruding from the actuating means and a slot engaging the pin which extends parallel to the inclined plane and reciprocates with the tool holding means.

4. The machine of claim 1 wherein the paths along which the first and second actuating means are reciprocable are substantially parallel to each other.

5. The machine of claim 1 wherein the paths along which the first and second actuating means are reciprocable are substantially perpendicular to the tool element displacement paths.

6. The machine of claim 1 wherein the plane surface portions of the first and second holding means are inclined oppositely with respect to the displacement paths.

7. The machine of claim 1 wherein the plane surface portions of the first and second holding means are inclined at different angles to the displacement paths.

8. A reciprocating device for producing consecutive strokes of different lengths, comprising:

a first member which is reciprocably moveable along a path parallel to that of the strokes;

a second member which is connected to the first member for reciprocating movement together with the first member, the second member being also rotatable with respect to the first member;

a toggle linkage pivotably connected at one end to the second member, and so connected at its other end that movement of the linkage between its flexed and toggled conditions produces the reciprocating movement of the first and second members; and means for restraining the second member from rotating through more than a predetermined angle, the restraining means being so constructed that movement of the linkage through its toggled condition in one direction causes rotation of the second member through said angle in both directions, while movement of the linkage through its toggled condition in the opposite direction does not cause rotation of the second member.

9. The device of claim 8 wherein the toggle linkage is so attached to the rotating member that movement through toggle in said one direction causes extension of the linkage at an angle to the path, while movement through toggle in said opposite direction causes extension of the linkage parallel to the path.

10. The device of claim 9 wherein the restraining means include pins protruding from the rotatable member and stops extending from the slidable member against which the pins abut at the end of the rotations.

11. A machine for operating on a workpiece from opposite sides by carrying out relative displacements along coaxial paths between a plurality of tool elements, the machine comprising:

first and second means for respectively holding first and second ones of the tool elements coaxially in positions confronting the same one side of the workpiece, the holding means being reciprocably moveable parallel to the tool displacement paths, and each holding means having a camming surface portion angularly positioned with respect to the displacements paths; and first and second actuating means for producing the reciprocal movements of the first and second holding means respectively, each actuating means having camming means which engages the camming surface portion of the respective holding means actuated thereby, and being moveable with respect to the camming surface portion so as to impart to said portion displacements parallel to said paths.

12. A machine for carrying out relative displacements along parallel paths between a plurality of tool elements, the machine comprising:

first and second means for holding different ones of the tool elements, the holding means being reciprocably moveable parallel to the tool displacement paths, and at least the first holding means having a plane surface portion inclined with respect to the displacements paths;

first and second actuating means for producing the reciprocal movements of the first and second holding means respectively, at least the first actuating means having a plane surface portion which mates with the inclined plane surface portion of the first holding means, and being reciprocable along a path which forms angles with the tool element displacement paths and with the plane surface of the first holding means, and the second actuating means including a toggle linkage connected between the second tool holding means and a non-reciprocable attachment means; and means for connecting the toggle linkage to the second actuating means, said connecting means being moveable into one position in response to the toggle linkage being brought into its fully extended condition from one flexed direction and into a second, different position in response to the toggle linkage being brought into its fully extended condition from the oppositely flexed direction, said connecting being so contructed that the fully extended toggle linkage is substantially parallel to the displacement paths in said one position of the connecting means and is at an angle to the displacement paths in the second position of the connecting means.

13. A machine for carrying out relative displacements along parallel paths between a plurality of tool elements, the machine comprising:

first and second means for holding different ones of the tool elements, the holding means being reciprocably moveable parallel to the tool displacement paths, and at least the first holding means having a plane surface portion inclined with respect to the displacement paths;

first and second actuating means for producing the reciprocal movements of the first and second holding means respectively, at least the first actuating means having a plane surface portion which mates with the inclined plane surface portion of the first holding means, and being reciprocable along a path which forms angles with the tool element displacement paths and with the plane surface of the first holding means, and the second actuating means including a toggle linkage connected between the second tool holding means and a non-reciprocable attachment means; and means for connecting the toggle linkage to the second actuating means, the connecting means comprising a disc rotatable relative to a member which is slidable parallel to the displacement paths, the linkage end being pivotally attached to the disc, and means being provided for restraining the disc from rotating through more than a predetermined angle.

14. The machine of claim 13 wherein the restraining means comprises means responsive to the flexing of the toggle linkage in said one direction to produce rotation of the disc through said angle in one direction, and to flexing in the said opposite direction to produce rotation through said angle in the opposite direction.

15. The machine of claim 14 wherein the restraining means includes two pins or lugs protruding from the disc, and three stop members extending into the paths of the pins.

16. The machine of claim 15 wherein the two pins are positioned at unequal peripheral distances from the pivotal attachment of the toggle linkage to the disc, and the third stop member is non-slidably positioned at one side of the disc that one of the pins is positioned between it and the other stop member on the same side of the disc.

17. A machine for carrying out relative displacements along parallel paths between a plurality of tool elements, the machine comprising:

first and second means for holding different ones of the tool elements, the holding means being reciprocably moveable parallel to the tool displacement paths, and at least the first holding means having a plane surface portion inclined with respect to the displacement paths;

first and second actuating means for producing the reciprocal movements of the first and second holding means respectively, at least the first actuating means having a plane surface portion which mates with the inclined plane surface portion of the first holding means, and being reciprocable along a path which forms angles with the tool element displacement paths and with the plane surface of the first holding means, the second holding means also having a plane surface portion inclined with respect to the displacement paths, and the second actuating means also having a plane surface portion which mates with the inclined plane surface portion of the second holding means, said second actuating means being also reciprocable along a path which forms angles with the tool element displacement paths and with the plane surface of the second holding means;

third means for holding a different one of the tool elements, said third holding means being also reciprocably moveable parallel to the tool displacement paths; and third actuating means for producing the reciprocal movements of the third holding means.

18. The machine of claim 17 wherein the third actuating means includes a toggle linkage connected between the third tool holding means and non-reciprocable attachment means.

19. The machine of claim 18 wherein the tool elements are a piercing punch, a piercing die, and a swaging punch.

20. The machine of claim 19 further comprising means for energizing the actuating means to produce reciprocal movements of the three tool holding means such that the die and punches cooperate to produce locking joints in materials placed between the punches.

21. The machine of claim 20 wherein the energizing means includes reciprocating hydraulically operated pistons connected to the three actuating means.

22. The machine of claim 21 wherein the hydraulic pistons connected to all three actuating means reciprocate at the same frequency.

23. The machine of claim 22 wherein at least one of the hydraulic pistons is connected to the pivot point of the toggle linkage and has a stroke sufficient to cause the linkage to go from one flexed condition through toggle into the opposite flexed condition and back again for each reciprocation of the piston.

24. The machine of claim 23 further comprising a stationary base member supporting the first and second holding means, a stationary support member spaced above the base member and to which is attached one end of the toggle linkage, and a cross bar slidably supported by columns extending between the stationary members, the bar constituting the third tool holding means, and the other end of the toggle linkage being attached to the bar.

25. The machine of claim 24 further comprising a plurality of first and second tool holding means supported upon the stationary base member, a corresponding plurality of tool elements held by the cross bar, and means for simultaneously reciprocating all the first and second tool holding means and the cross bar.

26. The machine of claim 18 comprising operating means for causing the toggle linkage to move from a first flexed position through toggle to the oppositely flexed position and back again through toggle to the first flexed position.

27. The machine of claim 18 wherein the toggle linkage is constructed so as to be substantially parallel to the tool displacement paths when fully extended.

* * * * *